US005933929A

United States Patent [19]

Kawakami et al.

[11] Patent Number: 5,933,929

[45] Date of Patent: Aug. 10, 1999

[54] SNAP BUTTON AND METHOD OF ATTACHING THE SAME

[75] Inventors: Katsunori Kawakami; Hirokazu Watanabe, both of Toyama-ken, Japan

[73] Assignee: YKK Corporation, Tokyo, Japan

[21] Appl. No.: 09/118,364

[22] Filed: Jul. 17, 1998

[30] Foreign Application Priority Data

Jul. 17, 1997 [JP] Japan ..... 9-192098

[51] Int. Cl.[6] ..... A44B 17/00

[52] U.S. Cl. ..... 24/681; 24/324; 24/679; 24/683

[58] Field of Search ..... 24/681, 683, 662, 24/679, 663, 324

[56] References Cited

U.S. PATENT DOCUMENTS

| | | | |
|---|---|---|---|
| 503,081 | 8/1893 | Hall | 24/681 |
| 1,832,830 | 11/1931 | Fenton | 24/681 |
| 2,799,910 | 7/1957 | Weber | 24/681 |
| 3,195,201 | 7/1965 | Ash, II . | |
| 3,229,343 | 1/1966 | Shears | 24/681 |
| 4,539,735 | 9/1985 | Kasai | 24/681 |
| 4,562,624 | 1/1986 | Kanzaka | 24/681 |

FOREIGN PATENT DOCUMENTS 39 32907 5/1990 Germany .

*Primary Examiner*—Victor N. Sakran
*Attorney, Agent, or Firm*—Hill & Simpson

[57] ABSTRACT

A snap button for attachment to a cloth is composed of male and female buttons engageable with each other. Each of the male and female buttons includes a face plate centrally from which a smashable shank projects, a snap body, and a resilient plate. The snap body has a respective one of concave socket and plug portions in which an axial shank-insertion hole, and a peripheral flange extending from a base portion of the plug and socket portions off an inner open end thereof. The resilient plate is adapted to be pierced by the shank so as to clamp the cloth between the face plate and the resilient plate. As a result, the cloth is held not only between the resilient plate and the shank but also between the shank and the snap body, and this clamp structure prevents the cloth from being removed off the each of the male and female buttons.

15 Claims, 15 Drawing Sheets

SNAP BUTTON AND METHOD OF ATTACHING THE SAME

BACKGROUND OF THE INVENTION

1. Field of the Invention

The present invention relates to a snap button composed of male and female members to be used as a fastener of, for example, clothing, and a method of attaching such a snap button to a cloth with resiliency.

2. Description of the Related Art

This type of snap button composed of male and female members is disclosed in Japanese Patent Laid-Open Publication No. Sho 47-8675. In this known snap button, as shown in FIG. 18 of the accompanying drawings, each of the male and female members 102, 101 has a shank 121, 110 projecting centrally from its face plate 104, 103. The male member 102 and the male member 101 have a spherical head 121' and a fitting recess 112 at their respective shanks 121, 110 so that they can be engaged for by a snap action. After corresponding parts of the cloth C-1 have been pierced by the respective shanks 121, 110 of the male and female face plates 104, 103, a pair of washers 121, 110 each having a central hole smaller in diameter than each shank 121, 110 are threaded respectively on the each shank 121, 110 to clamp each of the corresponding parts of the cloth C-1 between each face plate 104, 103 and each corresponding washer 151, 150.

In the meantime, Japanese Patent Laid-Open Publication No. Hei 8-173214 discloses a hook and eye fastener of synthetic resin. In this known hook and eye fastener, as shown in FIG. 19 of the accompanying drawings, the fastener comprises male and female bodies 206, 205, a pair of packing rings 261, 260 and a pair of face plates 204, 203. The female body 205 as a socket is made of polyacetal resin and has an axial plug-insertion recess 212, the recess 212 having centrally in its bottom a seated packing hole 214 on the outer side, while the male body 206 as a plug has a tubular shank 228, which is to be releasably fitted in the plug-insertion recess 212 of the female body 205, and centrally in the bottom of the tubular shank 228 on the outer side a seated packing hole 214. The packing rings 261, 260 are made of soft urethane resin and are fixed in the respective packing holes 225, 214 of the male and female bodies 206, 205 by fitting, gluing or welding. Each packing ring 261, 260 has a removal-prevention flange 265, 264 to contact with each seat 271, 270 of the male and female bodies 206, 205 and a central leg-insertion hole 263, 262. The face plates 204, 203 are made of polyacetal resin having an axial leg to be clenched. During attaching, the leg 221, 210 of each face plate 204, 203 is pierced through each of the corresponding parts of the cloth C-2 and inserted trough the respective packing ring 261, 260 and then, is clenched in the socket or plug of the corresponding bodies 206, 205. Thus attaching of the male and female bodies 206, 205 to the cloth C-2 has been completed. In use, the tubular shank 228 of the plug of the male member 202 is coupled and uncoupled with the undercut plug-insertion hole 212 of the socket of the female member 201. Further, Japanese Patent Laid-Open Publication No. Hei 8-294405 discloses an eye and hook fastener of synthetic resin, which comprises a female body 305 of a female member 301 as a socket, a male body 306 of a male member 302 as a plug, a pair of packings 360, 361 and pair of face plates 303, 304, as shown in FIG. 20 of the accompanying drawings. The female body 305 has a plug-insertion recess 312 on the inner side, the recess 312 having in its bottom a leg-insertion hole 314, while the male body 306 has a tubular shank 323, which is to be fitted in the plug-insertion recess 312 of the socket of the female body 305, and centrally in the bottom of the tubular shank 323 a leg-insertion hole 325. The face plate 303, 304 has an axial leg 310, 321 to be clenched. And each face plate 303, 304 has in its inner surface a packing recess 370, 371 for fixedly receiving each packing 360, 361 which is made of a soft urethane resin by gluing or welding. During attaching, with the cloth C-3 between each of the male and female bodies 306, 305 and the corresponding packing 361, 360, the leg 321, 310 of each face plate 304, 303 is pierced through each of the corresponding parts of the cloth C-3 and inserted trough the respective packing 361, 360 and, then, is clenched in the socket or plug of the corresponding bodies 306, 305. Thus attaching of the male and female members 302, 301 to the cloth C-3 has been completed. In use, the tubular shank 328 of the plug of the male body 306 is coupled and uncoupled with the socket of the female body 305.

In attaching such a conventional snap button to a cloth, it has been a common practice to clamp the cloth between a face plate, which bears on its outer surface an ornament, and each of plug and socket of male and female members by piercing the axial leg of the face plate through the cloth, threading the leg through a central leg-insertion hole of each of socket and plug, and then clenching the distal end of the axial leg of each face plate by a punch. Thus, each of the male and female buttons is attached to the cloth by a single clenching operation. For example, in the above-mentioned snap button of FIG. 20, the axial leg 321, 310 of the face plate 304, 303 is threaded through the packing 361, 360 and then pierced through the cloth and finally inserted into the central hole 325, 314 of each of the male and female bodies 306, 305, whereupon the axial leg 321, 310 of the face plate 304, 303 is clenched by the pressure of the punch. As a result each of the male and female members 302, 301 of the snap button is attached to the cloth by a single clenching operation.

However, these conventional snap buttons have the following problems.

In the first-named conventional snap button of FIG. 18, the axial shank 121, 110 of each of the male and female face plate 104, 103 itself is difficult to make slender and taper enough to pierce the cloth when attaching each of the male and female members 102, 101 to the cloth C-1. In fact, the shank 121, 110 is a particularly large-sized cylindrical tube so that the piercing of the shank 121, 110 through the cloth C-1 would be laborious and time-consuming. Further, since the washer 151, 150 is threaded on the shank 121, 110 and fixed only at the peripheral edge of the pierced hole of the cloth C-1, it would tend to be displaced in use, thus the cloth C-1 can not be clamped in a stable manner.

In the second-named conventional hook and eye fastener of FIG. 19, each of the plug and socket of the male and female bodies 206, 205 has in its rear surface a packing hole 225, 214, in which a soft urethane resin packing ring 261, 260 is stably secured by fitting, gluing or welding. However, since the leg 221, 210 of the face plate 204, 203 of the male or female body 261, 261 is pierced through the cloth and threaded through the packing 261, 260 and is then secured by clenching, the clamping of the cloth C-2 relies on only the clenching of the leg 221, 210, in which case the packing 261, 260 actually performs its original waterproofing feature but would be totally useless in securing the cloth C-2. Accordingly either of the male and female members 202, 201 would tend to become loose in securing after attached to the cloth.

Also in the third-named conventional synthetic resin hook and eye fastener of FIG. 20, like the second-named conventional fastener, partly since the cloth C-3 is clamped between a soft urethane resin packing 361, 360, which is secured in a packing recess 371, 370 in the inner surface of the respective face plate 304, 303 by fitting, gluing or welding and each of the plug and socket of the male and female bodies 306, 305, and partly since the axial leg 321, 310 of the respective face plate 304, 303 is clenched in the tubular shank 328 or the plug-insertion recess 312, the clamping of the cloth C-3 yet relies on only the clenching of the leg 321, 310 and would be little effective in securing the cloth. As a consequence, either of the male and female members 302, 301 would tend to become loose in securing after attached to the cloth.

Furthermore, in attaching the conventional snap button, since the snap button is secured at only one position to the plug or socket of the male and female members by clenching the axial leg of the respective face plate, adequate firm securing is difficult to achieve. Furthermore, since attaching of the snap button to the cloth takes place by a single stroke of the pressing punch, it is difficult to check any possible abnormality of the individual parts or elements during the pressing operation so that damaged or defect snap buttons might be manufactured.

SUMMARY OF THE INVENTION

With the foregoing conventional problems in view, it is a first object of the present invention to provide a snap button in which each of male and female buttons secures a cloth at two locations, i.e., between a resilient plate and an axial shank of a face plate and between a snap body and the shank, and can therefore be attached to the cloth firmly and simply without any accidental removal of the face plate. The face plate will not be removed from the cloth even if it would happen to suffer a breakage or other damage due to fatigue as the male and female buttons are repeatedly coupled and uncoupled, thus realizing a tough, double-fixed snap button.

A second object of the invention is to provide a snap button in which each resilient plate has such a shape that the face plate and the resilient plate can catch the cloth reliably and easily, thus achieving a firm and stable attachment.

A third object of the invention is to provide a snap button in which each of the male and female resilient plates has an inwardly curled peripheral edge, and the peripheral flange of each of the male and female snap bodies has an outwardly bent peripheral edge, and yet the socket/plug portions of each of the male and female snap bodies has an outwardly bulging bottom for pressing a respective one of the male and female resilient plates around its central hole, and therefore the resilient plate can press the cloth against the face plate by its entire surface to secure the cloth firmly and stably, realizing a damage-proof tough snap button.

A fourth object of the invention is to provide a snap button in which the resilient plate can be secured to the snap body reliably and firmly and can therefore be engaged with the shank in a stabilized posture and can be reinforced.

A fifth object of the invention is to provide a snap button in which each of the male and female resilient plates has a central hole smaller in diameter than an axial shank of a respective one of the male and female face plates, and the peripheral edge of the respective central hole is in biting engagement with each shank, and therefore enables the shank of the face plate to join with the resilient plate firmly without accidental removal.

A sixth object of the invention is to provide a snap button in which an outer surface of the respective peripheral flange of each of male and female snap bodies is located outward of the bottom of a respective one of the plug and socket portions, and each resilient plate is superposed over the outer surface of the respective peripheral flange, and yet each of the male and female snap bodies has around the respective shank-insertion hole a peripheral recess for allowing each resilient plate to deform, thereby locating the resilient plate in a stabilized posture against the snap body and facilitating resilient deformation of the resilient plate and also clamping the cloth margin without difficulty.

A seventh object of the invention is to provide a snap button in which the peripheral edge of the central hole of each resilient plate is inwardly bent so as to bite into a respective one of the shanks and, therefore, the shank of the face plate can be threaded through the snap body reliably and simply without accidental removal.

An eighth object of the invention is to provide a snap button in which the bottom of each of the plug and socket portions is located outward of a respective one of the peripheral flanges of the male and female snap bodies so as to clamp the cloth between the bottom and each face plate, and each resilient plate is a small-sized frustum resilient plate mounted in a respective one of the concave plug and socket portions, and yet each shank is smashed so as to engage the frustum resilient plate, and therefore the resilient plate can be engaged with the shank of the face plate simply and reliably to achieve adequate engagement by yet the small-sized resilient plate and also to save material, thus resulting in reduction of price.

A ninth object of the invention is to provide a snap button in which each face plate is made of a material softer than that of each resilient plate and the shank of each face plate has an axial hollow portion therein. Therefore, the shank can be smashed or clenched without difficulty, so that quick and reliable attachment of the snap body to the cloth can be achieved, thus improving the attaching efficiency.

A tenth object of the invention is to provide a snap button in which each face plate and each snap body are molded of thermoplastic resin and each resilient plate is made from a metal sheet, and therefore reliable engagement can be achieved using optimum materials for the snap body, the face plate and the resilient plate so that an ideal snap button can be realized.

An eleventh object of the invention is to provide a method of attaching a snap button to a cloth, which enables each snap body of the snap button to be secured to the shank of each face plate firmly at certain positions using the respective resilient plate and also enables inspection intermediate between the first and second steps by the operator's eyes so that reliable checking can be performed on whether or not the cloth is surely held between the face plate and the resilient plate, thereby guaranteeing a damage-free snap button.

A twelfth object of the invention is to provide a method of attaching a snap button to a cloth in which the snap button can be attached to the cloth simply in various forms in option by specifying the punch or punches utilizing each of the male and female face plates, the respective snap bodies and the respective resilient plates.

According to a first aspect of the invention, the above primary object is accomplished by a snap button, for attachment to a cloth, which is composed of male and female buttons adapted to be coupled together, the male and female buttons comprising: a male face plate having a smashable shank projecting centrally from its inner surface for piecing a first part of the cloth; a male snap body having a concave plug portion, a shank-insertion hole extending axially through the plug portion, and a peripheral flange extending from a base portion of the plug portion off an inner open end thereof; a male resilient plate adapted to be pierced by the shank so as to press the first part of the cloth against the inner surface of the male face plate; a female face plate having a smashable shank projecting centrally from its inner surface for piecing a second part of the cloth; a female snap body having a concave socket portion, a shank-insertion hole extending axially through the socket portion, and a peripheral flange extending from a base portion of the socket portion off an inner open end thereof; and a female resilient plate adapted to be pierced by the last-mentioned shank so as to press the second part of the cloth against the inner surface of the female face plate.

According to a second aspect of the invention, each of the male and female resilient plates has an arcuate surface complementary to the inner surface of a respective one of the male and female face plate.

According to a third aspect of the invention, each of the male and female resilient plates has an inwardly curled peripheral edge, each of the male and female snap bodies having an outwardly bent peripheral edge, and each of the plug and socket portions has an outwardly bulging bottom for pressing a respective one of the male and female resilient plates around its central hole.

According to a fourth aspect of the invention, an outer peripheral edge of each resilient plate is embedded in the outer peripheral edge of a respective one of the peripheral flanges of the male and female snap bodies.

According to a fifth aspect of the invention, each of the male and female resilient plates has a central hole smaller in diameter than a respective one of the shanks, and a peripheral edge of the central hole is in biting engagement with each shank.

According to a sixth aspect of the invention, each resilient plate is initially devoid of a central hole and is adapted to be pierced by a respective one of the shanks under pressure.

According to a seventh aspect of the invention, an outer surface of each of the peripheral flanges of the male and female snap bodies is located outward of the bottom of a respective one of the plug and socket portions, each resilient plate being superposed over the outer surface of a respective one of the peripheral flanges, each of the male and female snap bodies having around a respective one of the shank-insertion holes a peripheral recess for allowing each resilient plate to deform.

According to an eighth aspect of the invention, the peripheral edge of the central hole of each resilient plate is inwardly bent so as to bite into a respective one of the shanks.

According to a ninth aspect of the invention, the bottom of each of the plug and socket portions is located outward of a respective one of the peripheral flanges of the male and female snap bodies so as to clamp the cloth between the bottom and each face plate, and each resilient plate is a small-sized frustum resilient plate mounted in a respective one of the concave plug and socket portions, and each shank is smashed so as to engage the frustum resilient plate.

According to a tenth aspect of the invention, each face plate is made of a material softer than that of each resilient plate, the shank of each face plate having an axial hollow portion therein.

According to an eleventh aspect of the invention, each face plate and each snap body are molded of thermoplastic resin, and each resilient plate is made from a metal sheet.

According to a twelfth aspect of the invention, there is provided a method of attaching to a cloth a snap button composed of male and female snap buttons, each having a face plate, a shank projecting centrally therefrom, a resilient plate and a snap body having a shank-insertion hole, the method comprising: a first step of piercing the shank of the face plate of each of the male and female buttons through a respective one of first and second parts of the cloth, inserting the shank through a central hole, which is smaller in diameter than the shank, of the resilient plate to clamp a respective one of the first and second part of the cloth between the resilient plate and the face plate; and a second step of pressing the shank, which is inserted through the shank-insertion hole of the snap body of each of the male and female buttons to smash the shank in the snap body.

According to a thirteenth aspect of the invention, in the first step, the resilient plate is pressed first at its outer peripheral edge and then at a peripheral edge of the central hole to bring the resilient plate into engagement with the shank of the face plate.

According to a fourteenth aspect of the invention, in the first step, each resilient plate with the peripheral edge of its central hole resiliently deformable is superposed over the inner surface of each of the male and female snap bodies, and pressed against each snap body, thereby engaging each shank of each face plate.

According to a fifteenth aspect of the invention, in the first step, each snap body and a respect one of the first and second part of the cloth are threaded on each shank of the face plate, and a small-sized resilient plate is then threaded on each shank and is pressed against each snap body, thereby engaging each shank of each face plate.

BRIEF DESCRIPTION OF THE DRAWINGS

The above and other objects, advantages and features of the present invention will be more apparent from the following description with reference to the accompanying drawings in which.

DETAILED DESCRIPTION OF THE PREFERRED EMBODIMENTS

The principle of the present invention is particularly useful when applied to a snap button, various embodiments of which will now be described with reference to the accompanying drawings.

Though the present specification, the terms "outwardly", "inwardly", "outer" and "inner" are regarded as "axially outwardly", "axially inwardly", "axially outer" and "axially inner", respectively, with respect to the imaginary plane in which male and female buttons are to be coupled with each other. Exceptionally, the terms "outer peripheral" and "inner peripheral" are regarded as "radially outer peripheral" and "radially inner peripheral", respectively, with respect to the center of either the male or female button as in usage. Further, the same reference numbers designate similar parts or elements throughout the different views of several embodiments.

Figure 1:
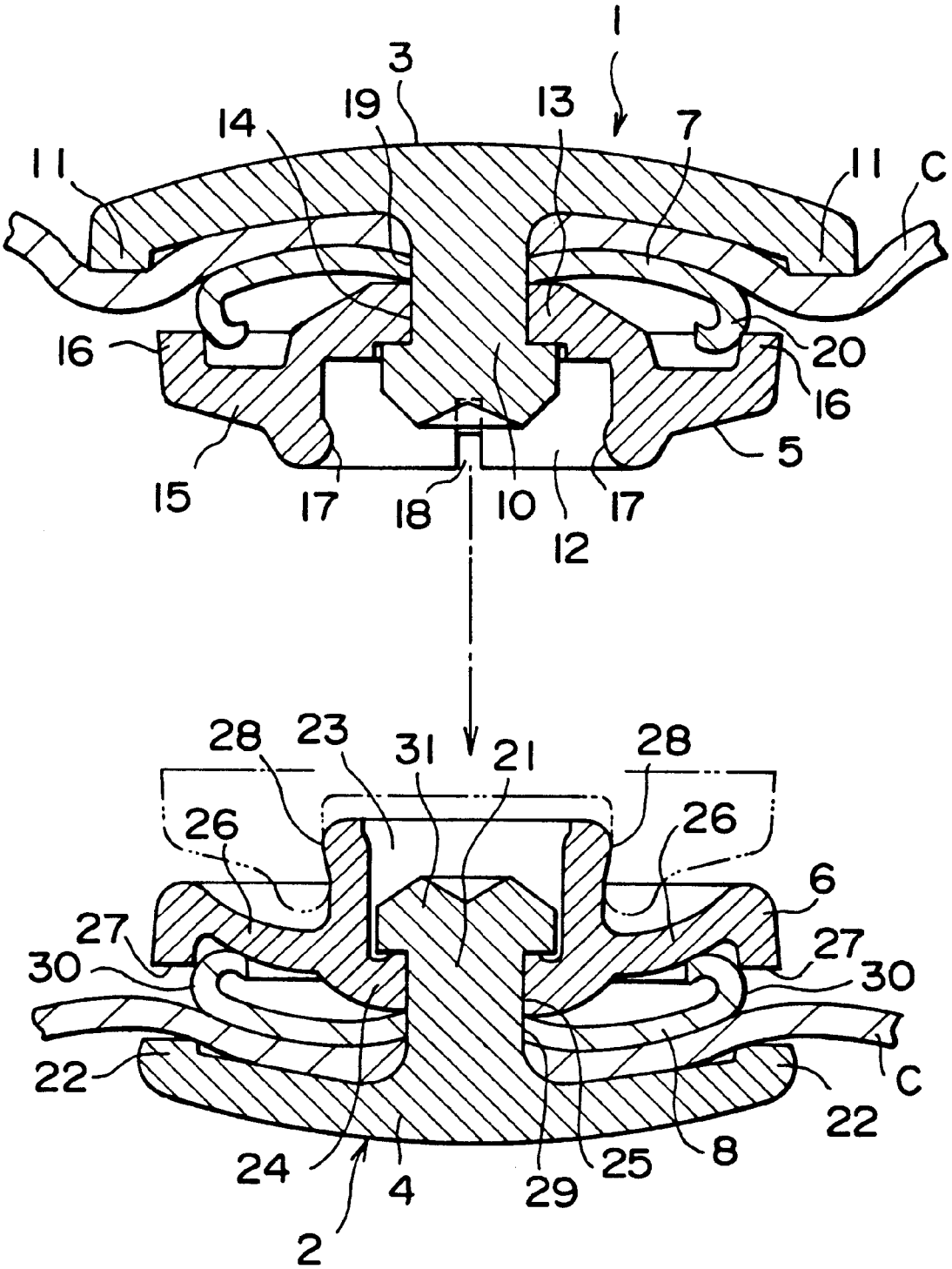
FIG. 1 is a cross-sectional view showing a set of male and female buttons of a snap button according to a first embodiment of the present invention.
Figure 2:
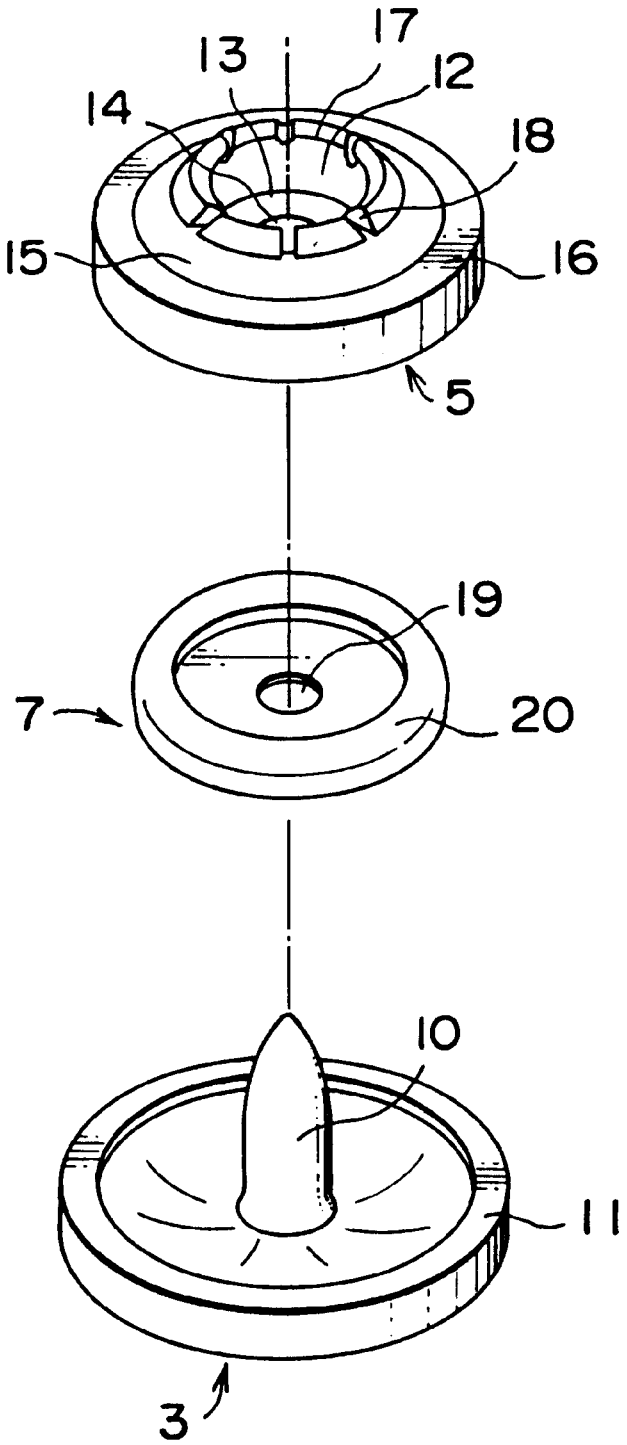
FIG. 2 is an exploded perspective view showing the female button of the snap button before having been assembled.
Figure 3:
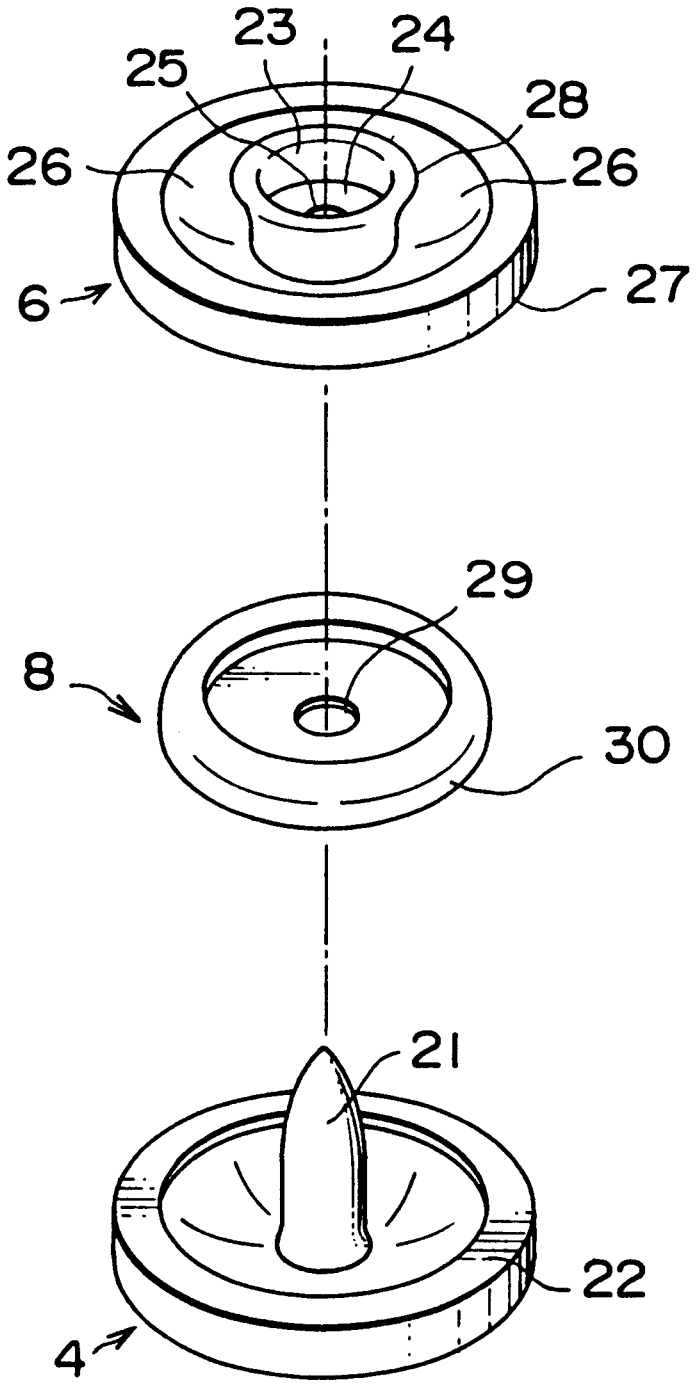
FIG. 3 is an exploded perspective view showing the male button of the snap button before having been assembled.

FIGS. 1 to 5 show a snap button according to a first embodiment of the invention. As shown in FIG. 1, the snap button is composed of male and female buttons 1, 2. Each of the male and female buttons 1, 2, as respectively shown in FIGS. 2 and 3, has a three-member structure composed of a face plate 3, 4, a snap body 5, 6, and a resilient plate 7, 8. Each of the face plate 3, 4 and the snap body 5, 6 is molded in a unitary form by injection or extrusion molding using thermoplastic resin, such as polyacetal, polyamide, polypropylene or polybutyleneterephtalate, while the resilient plate 7, 8 is preferably made from a metal sheet but may be molded of above-described thermoplastic resin.

The face plate 3 of the female button 1 (hereinafter also called simply the female face plate) is in the form of an outwardly slightly convex disk having centrally on its inner surface a tapering axial shank 10, which is adapted to be smashed or clenched as described below. The female face plate 3 further has an inwardly bent outer peripheral edge 11. The outer surface of the female face plate 3 may serve as an ornament selectively bearing any optional combination of various designs, colors and/or shapes.

The snap body 5 of the female button 1 (hereinafter also called simply the female snap body) has a concave socket portion 12 at its center, the bottom 13 of which has a central shank-insertion hole 14. The snap body 5 further has a peripheral flange 15 extending radially outwardly from a periphery of a base of the concave socket portion 12 off an inner open end thereof and having an outwardly bent outer peripheral edge 16. An outer surface of the bottom 13 of the socket portion 12 protrudes outwardly of the peripheral flange 15. The socket portion 12 has an annular ridge 17 slightly bulging radially inwardly from its open end and having a plurality of notches 18 at predetermined positions so that the inner open end of the socket portion 12 can be deformed more easily.

The resilient plate 7 of the female button 1 (hereinafter called simply the female resilient plate) is in a form of an outwardly curved plate having a central hole 19 smaller in diameter than the shank 10 of the face plate 3 so that the shank 10 cannot be inserted through the shank-insertion hole 19 unless it is pushed under relatively great pressure. The female resilient plate 7 also has an inwardly curled outer peripheral edge 20 and is therefore resiliently touchable with the outer peripheral edge 16 of the snap body 5. The resilient plate 7 is complementary in shape to the inner surface of the face plate 3. As an alternative, the inner edges of the central hole 19 of the female resilient plate 7 may be sawtoothed, and as another alternative, the female resilient plate 7 may be devoid of any central hole, in which case the shank 10 of the female resilient plate 7 can be pierced through the resilient plate 17 under great pressure.

Next, the male button 2 is substantially identical in structure with the female button 1. For example, the face plate 4 of the male button 2 (hereinafter also called simply the male face plate) is in a form of an outwardly slightly convex disk having centrally on its inner surface a tapering axial shank 21, which is adapted to be smashed or clenched as described below, and has an inwardly bent outer peripheral edge 22.

The snap body 6 of the male button 2 (hereinafter also called simply the male snap body) has a concave plug portion 23, the bottom 24 of which has a center shank-insertion hole 25, and a peripheral flange 26 extending projecting radially outwardly from the center of the plug portion 23. The male snap body 6 further has an outwardly bent outer peripheral edge 27. This plug portion 23 of the male snap body 6 is adapted to be inserted into the socket portion 12 of the female snap body 5 by snap action. An outer surface of the bottom 24 of the plug portion 23 protrudes outwardly of the outer surface of the peripheral flange 26. The plug portion 23 has an annular protuberance 28 slightly bulging radially outwardly from its open end, so that the annular protuberance 28 of the plug portion coupled with the annular ridge 17 of the socket portion 12 of the female button 1 in snap action when the plug portion 23 is fitted in the socket portion 12.

The resilient plate 8 of the male button 2 (hereinafter also called simply the male resilient plate)is in a form of an outwardly curved plate having a central hole 29 smaller in diameter than the shank 21 of the face plate 4 so that the shank 21 cannot be inserted through the central hole 29 unless it is pushed under relatively great pressure. The male resilient plate 8 has also an inwardly curled outer peripheral edge 30 and is therefore resiliently touchable with the outer peripheral edge 27 of the male snap body 6. The male resilient plate 8 is complementary in shape to the inner surface of the male face plate 4. As an alternative, the inner edges of the central hole 29 of the male resilient plate 8 may be serrated, and as another alternative, the male resilient plate 8 may be devoid of any central hole so that the shank 21 of the male face plate 4 can be pierced through the male resilient plate 8 under great pressure.

A first method of attaching the male and female buttons 1, 2 to the cloth using a first assembling tool will now be described. As the male and female buttons 1, 2 are first individually assembled in the same manner, assembling of only the male button 2 is described here.

Figure 4:
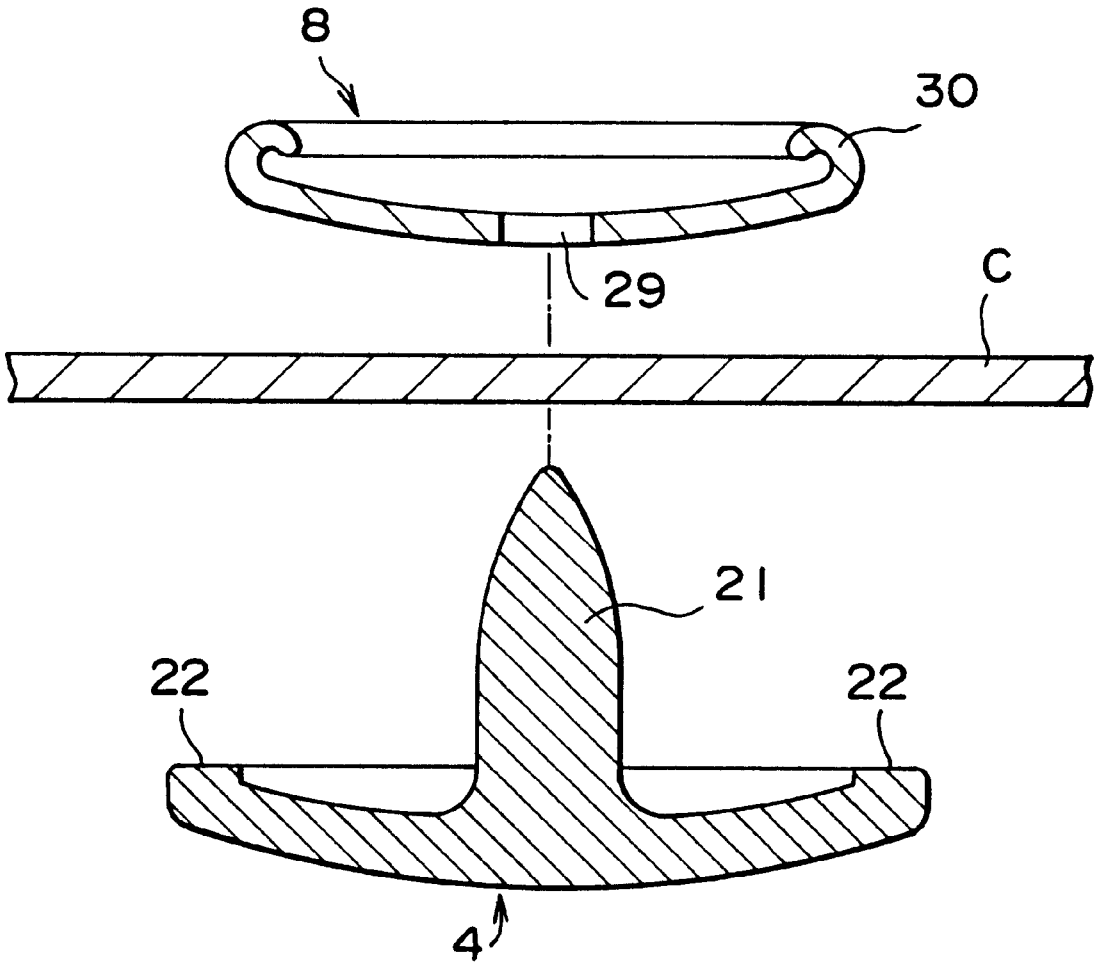
FIG. 4 is a cross-sectional view showing the manner in which a face plate and the resilient plate are assembled.

As shown in FIG. 4, first the cloth C is placed over the shank 21 of the face plate 4 and then the resilient plate 8 is placed over the cloth C in such manner that the central hole 29 of the resilient plate 8 is axially (vertically in FIG. 4) aligned with the shank 21 of the face plate 4, whereupon the shank 21 is forced into the central hole 29 as pressed by a non-illustrated punch. At that time, the shank 21 pierces the cloth C and expands the central hole 29 and, as a result, the peripheral edge of the central hole 29 comes to bite the shank 21 so as the cloth C can be firmly held between the face plate 4 and the resilient plate 8.

Figure 5:
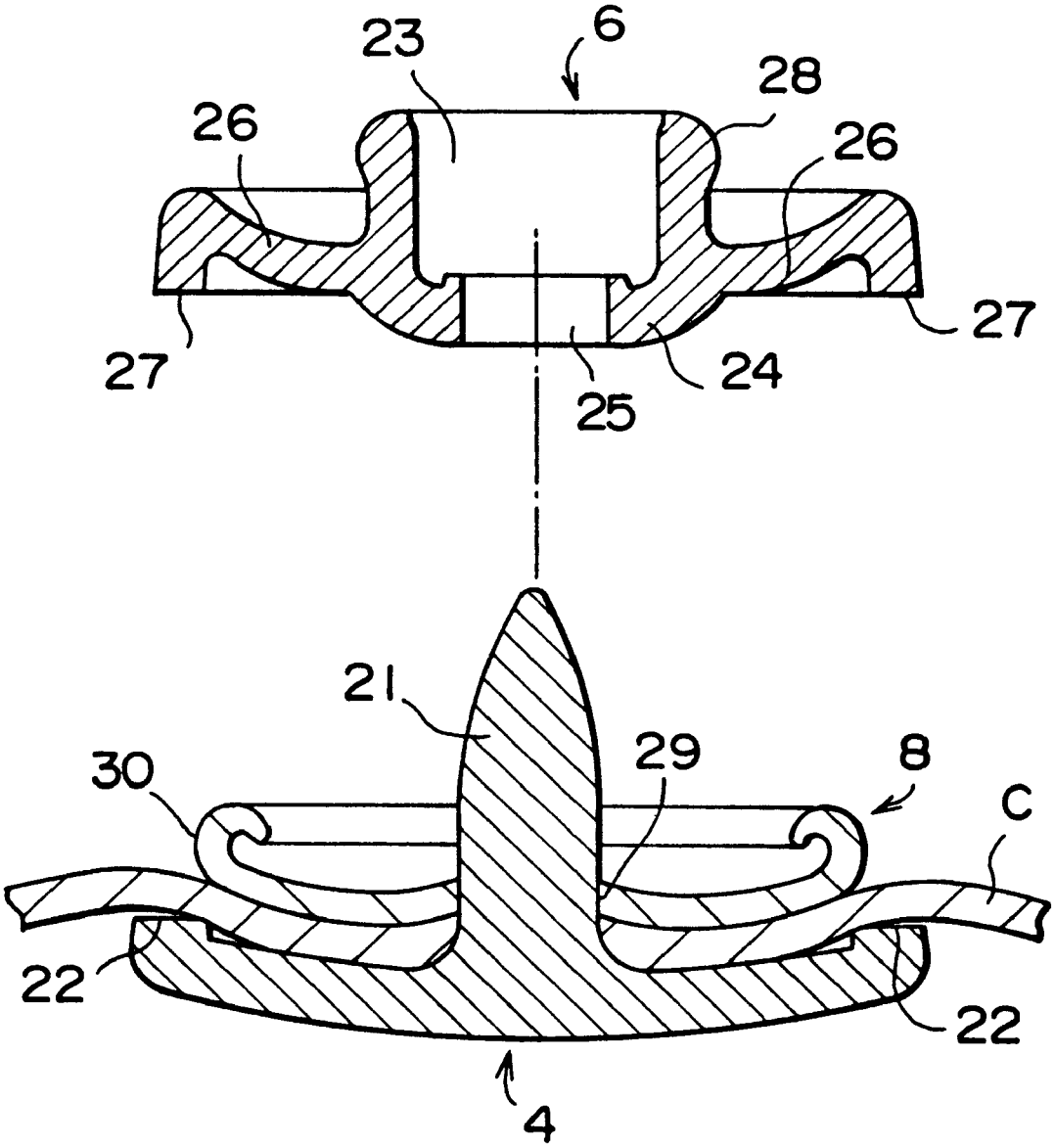
FIG. 5 is a cross-sectional view showing the manner in which the face plate and the snap body are assembled.
Figure 9:
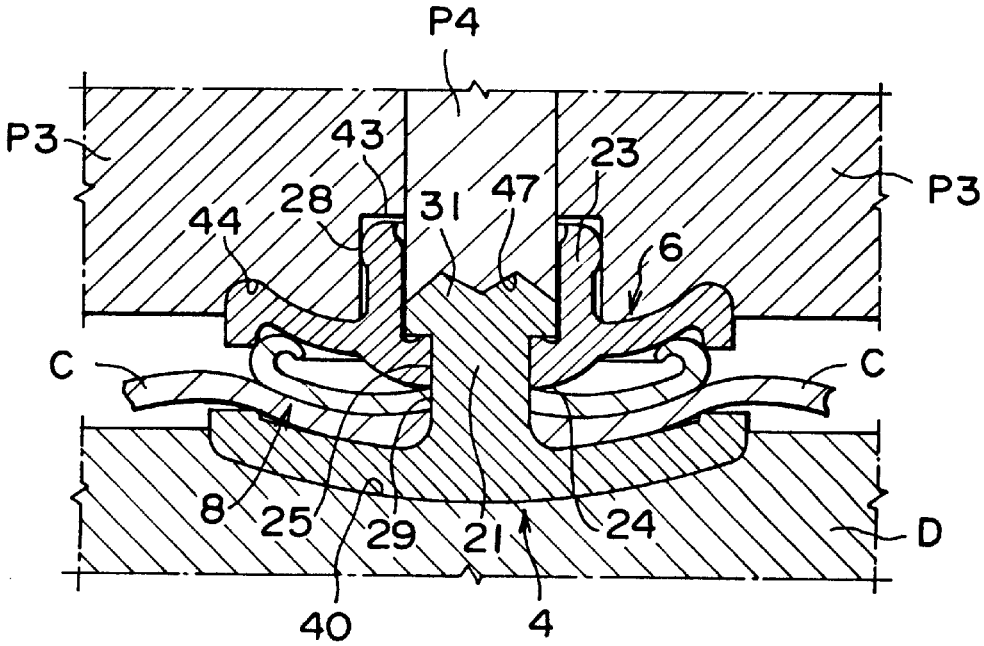
FIG. 9 is a cross-sectional view showing how the assembling tool is operated in a second step of the first method.

Then, the snap body 6 is placed over the assembled front plate 4 and resilient plate 8, in such a manner that the axial shank-insertion hole 25 is put in axial alignment with the distal end of the shank 21 as shown in FIG. 5, whereupon the shank 21 is inserted through the axial shank-insertion hole 25. Finally, the distal end of the shank 21 is smashed or clenched by the punch so as to form a swelled portion 31, as shown in FIG. 9, thereby fixing the face plate 4 and the snap body 6 together. Therefore, the cloth C is clamped between the face plate 4 and the resilient plate 8, and the bottom 24 of the plug portion 23 of the snap body 2 presses the resilient plate 8 against the cloth C and the face plate 4 to hold the cloth C firmly in position. Further, since this securing of the cloth C takes place at two positions, i.e., between the resilient plate 8 and the shank 21 and between the shank 21 and the snap body 6, it is possible to catch the cloth C around the shank 21 with increased firmness and to thereby attach the male button 2 to the cloth C much more stably.

Figure 6:
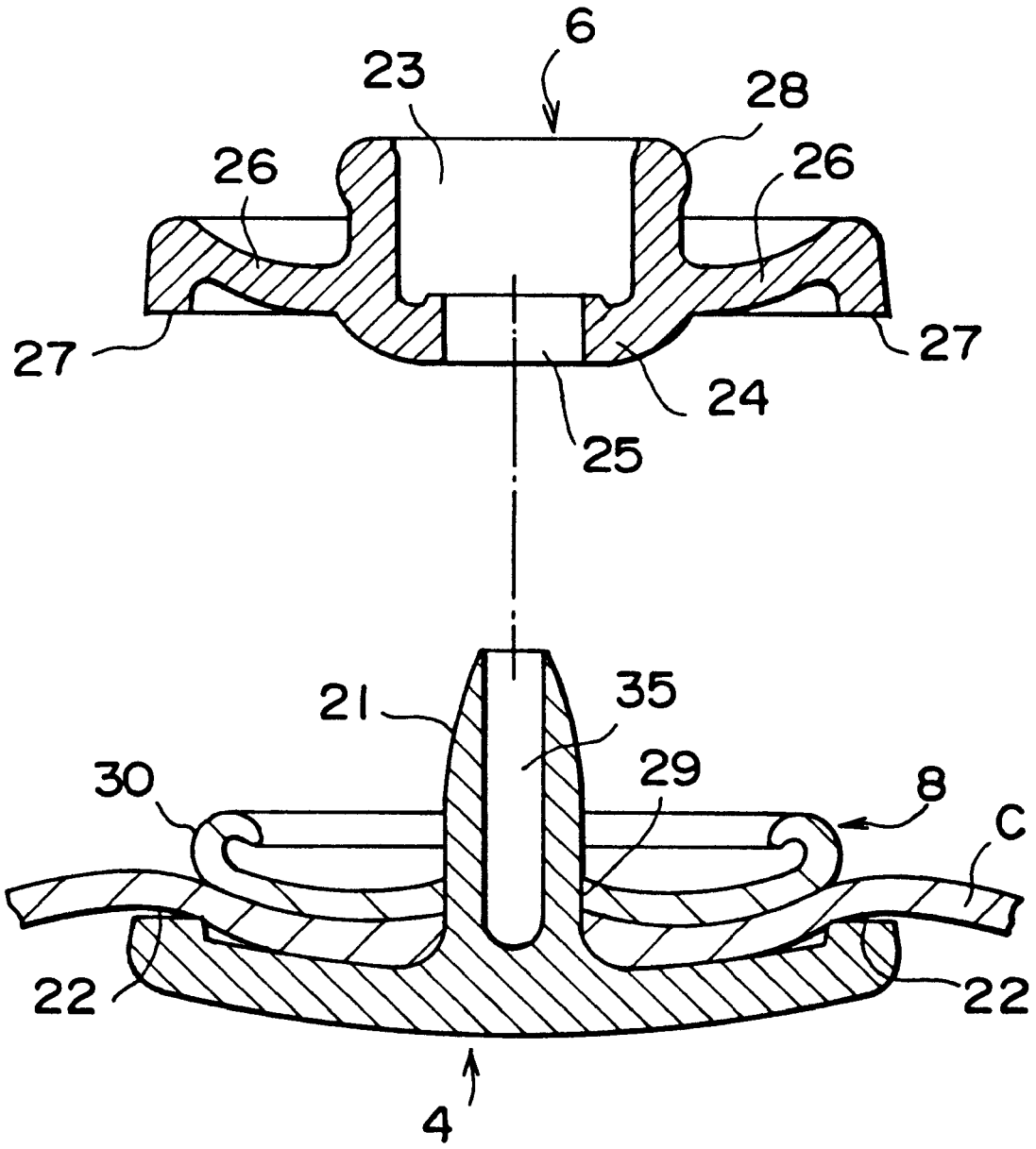
FIG. 6 is a cross-sectional view of a modification of the male button having a modified axial shank of the face plate with an axial hollow portion therein.
Figure 7:
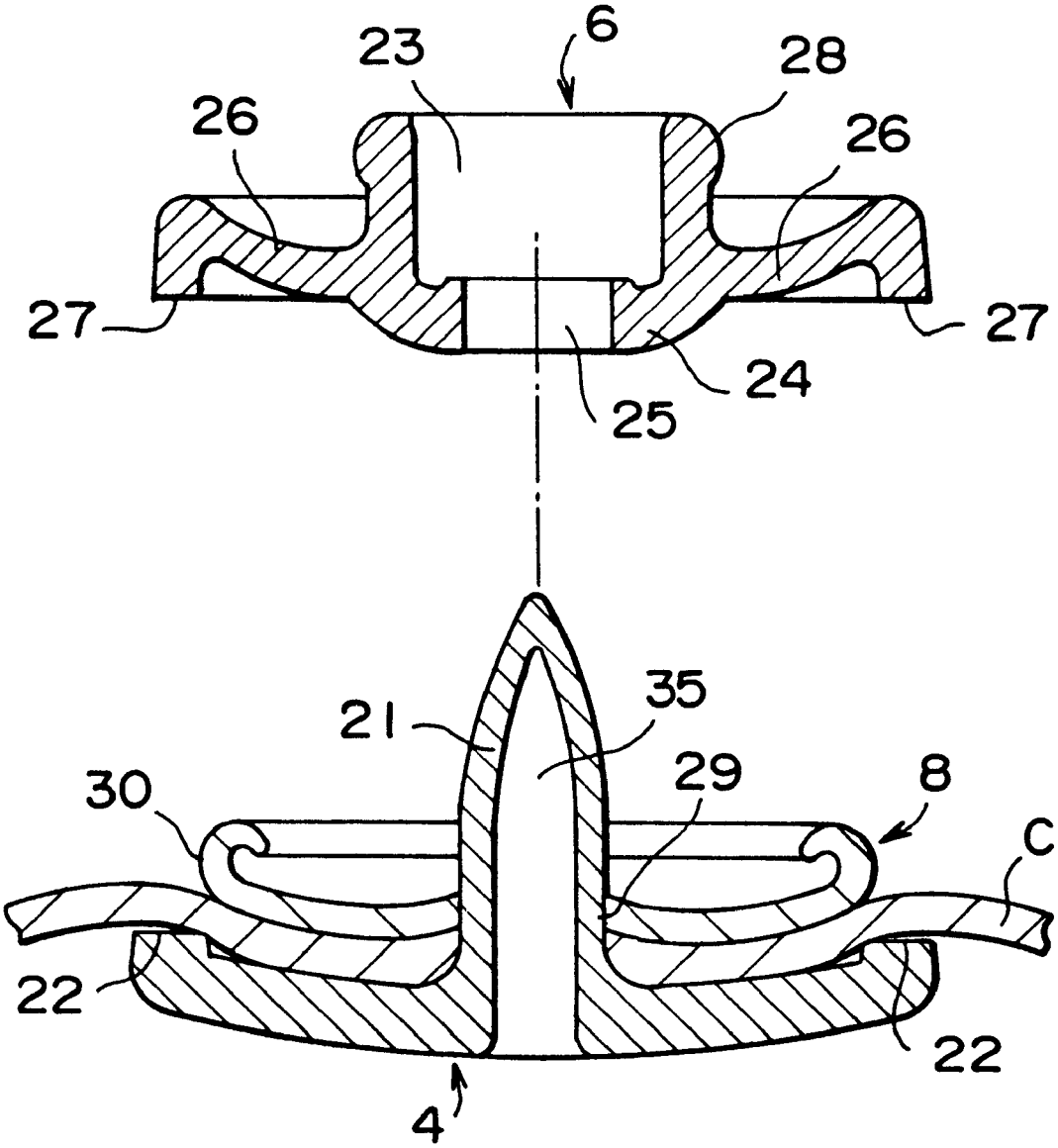
FIG. 7 is a cross-sectional view of another modification of the male button having another modified axial shank of the face plate with an axial hollow portion therein.

FIG. 6 shows a modification of the male button 2 with a modified face plate 4, the axial shank 21 of which is in a form of a tube having an axial hollow portion 35 at its center and tapering at its open distal end for facilitating piercing the cloth C. FIG. 7 shows another modification of the male button 2 with another modified face plate 4, the axial shank 21 of which is in a form of a bullet having an axial hollow portion 35 opening at its base.

After having been fixedly threaded through the resilient plate 8, the tubular shank 21 of FIG. 6 is inserted through the snap body 6 and is then smashed or clenched to open wide in the plug portion 23 of the snap body 6. The bullet-shape shank of FIG. 7, on the other hand, is inserted through the snap after having been threaded fixedly through the resilient plate 8.

The face plate 4 having the shank 21 with the hollow portion 35 is preferably made of softer material than the resilient plate 8, or may be made of thermoplastic resin. Alternatively, it may be made of metal such as aluminum alloy, zinc alloy, or etc.. The resilient plate 8 is preferably made from stainless steel.

Figure 8:
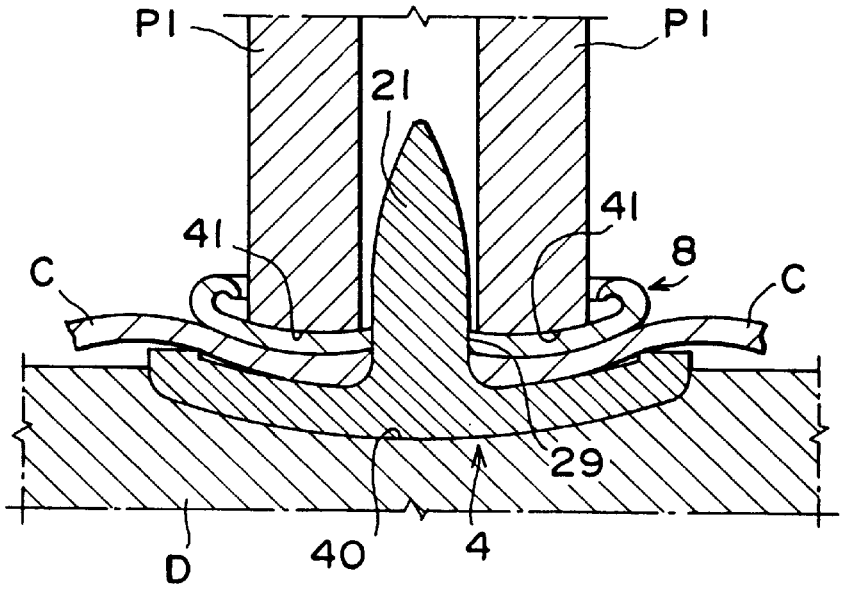
FIG. 8 is a cross-sectional view showing how an assembling tool for the snap button of the first embodiment is operated in a first step of a first snap-button attaching method according to the invention.

The method for attaching the male and female buttons 1, 2 to the cloth will now be described more specifically with reference to FIGS. 8 and 9. With the face plate 4 of the male button 2 is supported in a seat recess 40 of a die D, the male resilient plate 8 is pressed by a tubular first punch P1 as shown in FIG. 8, so that the shank 21 pierced through the cloth C is inserted through the axial shank-insertion hole 29 of the resilient plate 8. Thus, the cloth C is clamped between the face plate 4 and the resilient plate 8 so that the resilient plate 8 is brought into biting engagement with the shank 21 of the face plate 4. The pressing surface of the first punch P1 is curved as an arcuate surface 41 complementary to the curvature of the inner surface (upper in FIG. 8) of the resilient plate 8.

After the resilient plate 8 has thus been into engagement with the shank 21, the punch is retracted. The snap body 6 held by a tubular third punch P3 is threaded on the shank 21 and then a rod-shape fourth punch P4 mounted in the third punch P3 is lowered toward the die D to smash and clench the shank 21 projecting into the plug portion 23 of the snap body 6 to form an swelled end 31, thereby fixedly joining the snap body 6 and the shank 21. As a result, the cloth C is clamped with increased reliability between the face plate 4 and the snap body 6 by synergy of the connection between the resilient plate 8 and the shank 21 and that between the shank 21 and the snap body 6.

The third and fourth punches P3, P4 (FIG. 9) will now be described more in detail. The pressing surface of the tubular third punch P3 is defined partly by an annular cutout 43 at its inner side for receiving the plug portion 23 of the snap body 6 and partly by an annular groove 44 contiguous to and outward of the annular cutout 43 for receiving the peripheral flange 26 of the resilient plate 8. The inside wall of the annular cutout 43 of the third punch P3 presses the annular protuberance 28 of the plug portion 23 to thereby hold the male snap body 6. In the meantime, an pressing surface of the fourth punch P4 has an uneven surface 47 that serves to reinforce the peripheral edge of a possible swelled end 31 during clenching.

The foregoing male-button attaching method can be adopted to the attaching of the female button 1. Particularly for attaching the female button 1 utilizing the third punch P3, it is only necessary to give a minor modification to the third punch P3. For example, a non-illustrated annular projection may be substituted for the cutout 43 in the pressing surface of the third punch 3 to receive the socket portion 12 of the female snap body 5 so that the inside surface of the annular projection comes against the annular ridge 17 of the socket portion 12 to thereby hold the female snap body 5.

Figure 10:
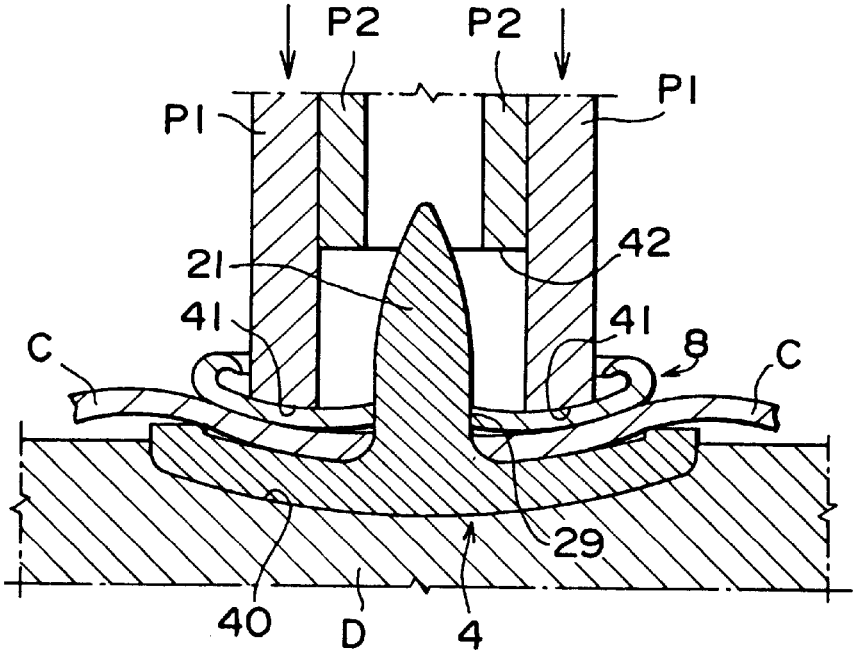
FIG. 10 is a cross-sectional view showing how a primary part of operation of an alternative assembling tool for the same snap button in a first step of a second snap-button attaching method according to the invention.
Figure 11:
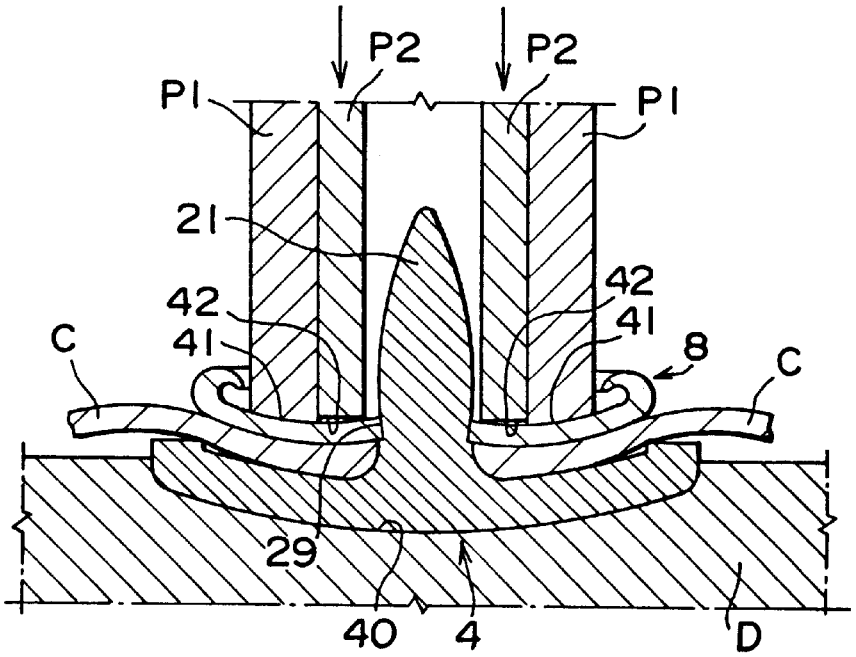
FIG. 11 is a cross-sectional view showing a secondary part of operation of the assembling tool in the first step of the second method.

As an alternative means (second method) for engaging the resilient plate 8 with the shank 21 of the face plate 4 of the male button 2, in the first step as shown in FIGS. 10 and 11, the resilient plate 8 may be pressed in a double step by employing a tubular second punch P2 in addition to the tubular first punch P1. Namely, the outer-peripheral-edge side, i.e., the curled-edge side of the resilient plate 8 is pressed by the tubular first punch P1 for engagement with the shank 21. For this purpose, the pressing surface of the tubular first punch P1 are curved as an arcuate surface 41 complementary to the inner curvature of the resilient plate 8.

Upon engagement of the resilient plate 8 with the shank 21 by the tubular first punch P1, the tubular second punch P2, which is telescopically mounted inside the tubular first punch P1, presses the resilient plate 8. The pressing surface of the second punch P2 is flat as a horizontal surface 42 to press the peripheral edge of the central hole 29 of the resilient plate 8. As a result, the peripheral edge of the central hole 29 of the resilient plate 8 bites relatively deeply into the shank 21 as shown in FIG. 11, thereby clamping the cloth C between the resilient plate 8 and the face plate 4 with increased firmness.

Figure 12:
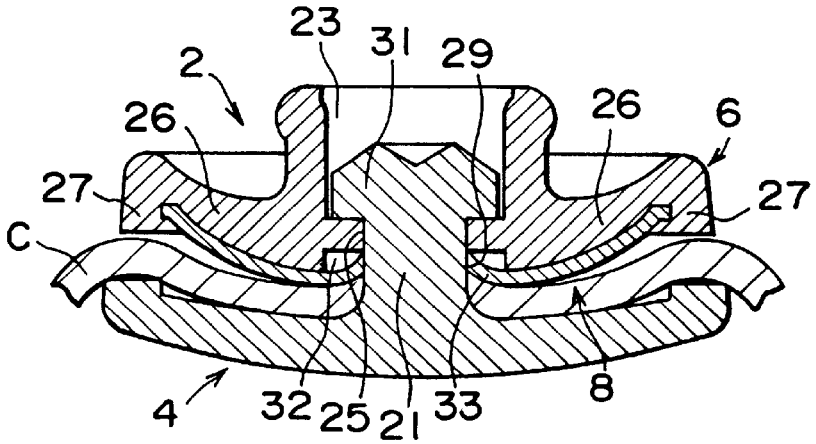
FIG. 12 is a cross-sectional view of a modified male button according to a second embodiment of the invention.

FIG. 12 shows a modified snap button (only a modified male button 2 is shown) according to a second embodiment of the invention. The modified male button 2, like the male button 2 of the first embodiment, is basically composed of a face plate 4, a snap body 6 and a resilient plate 8. The face plate 4 is substantially identical in structure with that of the first embodiment, while the snap body 6 and the resilient plate 8 are somehow different in structure from those of the first embodiment. Namely, in the modified male button 2, unlike the male button 2 of the first embodiment, the outer surface of a peripheral flange 26 extending from a base end of a modified plug portion 23 is located outward of the outer surface of a bottom 24 of the modified plug portion 23 to form step between them, thereby defining a peripheral recess 32.

In production, the modified resilient plate 8 is in a form of a slightly curved plate and has a central hole 29. The peripheral edge of the central hole 29 is bent inwardly as an inwardly bent inner peripheral edge 33 curving in the same direction as that of the curving of the resulting metal plate. When the resilient plate 8 and is superposed and pressed against the snap body 6, the bent inner peripheral edge 33 can be resiliently deformed within the peripheral recess 32 of the snap body 6. Yet the modified resilient plate 8 is devoid of any curl in its inner peripheral edge so that the curl-free outer peripheral edge can be embedded in an outwardly bent outer peripheral edge 27 of the peripheral flange 26, thus assuming a stabilized posture on the peripheral flange 26. Regarding the remaining structural features, the modified male button 2 is totally identical with that of the first embodiment. The foregoing description of the modified male button 2 can be adopted to the modified female button 1.

Now, a third method of attaching the modified male and female buttons 1, 2 of the second embodiment to the cloth will now be described using FIGS. 13 and 14.

Figure 13:
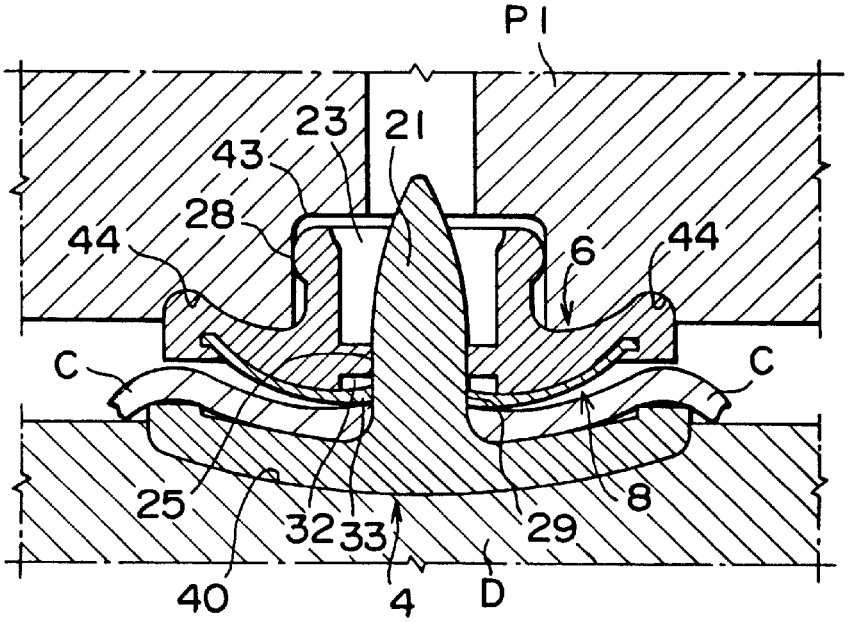
FIG. 13 is a cross-sectional view showing the operation of another alternative assembling tool for the male button of the second embodiment in a first step of a third snap-button attaching method according to the invention.
Figure 14:
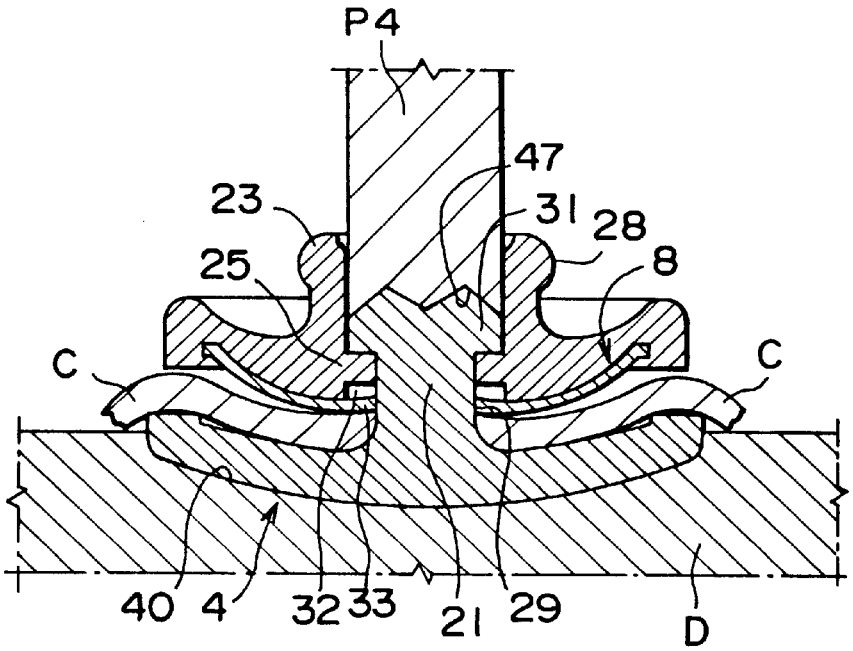
FIG. 14 is a cross-sectional view showing the operation of the assembling tool in a second step of the third method.

In the first step of the third method, with the face plate 4 of the modified male button 2 supported in a seat recess 40 of a die D, an alternative tubular first punch P1 holding the superposed modified male resilient plate 8 and snap button 6 by its pressing surface is lowered as shown in FIG. 13 so that the shank 21 of the face plate 4 pierced through the cloth C is inserted through the central hole 29 of the resilient plate 8 and the insertion hole 25 of the snap body 6. Thus, the cloth C is clamped between the face plate 4 and the resilient plate 8 so that the resilient plate 8 is brought into biting engagement with the shank 21 of the face plate 4.

A pressing surface of the alternative tubular first punch P1 is defined partly by an annular cutout 43 at its inner side for receiving the plug portion 23 of the snap body 6 and partly by an annular groove 44 contiguous to and outward of the annular cutout 43 for receiving the peripheral flange 26 of the resilient plate 8. As the alternative first punch P1 is lowered toward the die D, the inside wall of the annular cutout 43 comes against the annular protuberance 28 of the plug portion 23 to thereby hold the male snap body 6. For attaching the modified female button 1 of the second embodiment utilizing the alternative first punch P1, it is only necessary to give a minor modification to the alternative first punch P1. For example, a non-illustrated annular projection may be substituted for the cutout 43 in the pressing surface of the alternative first punch P1 to receive the socket portion 12 of the modified female snap body 5 so that the inside surface of the annular projection comes against the annular ridge 17 of the socket portion 12 to thereby hold the female snap body 5.

Upon completion of biting engagement of the inwardly bent inner peripheral edge 33 of the central hole 29 of the resilient plate 8 with the shank 21, the alternative first punch P1 is retracted away from the die D. After that, in the second step of the third method, as shown in FIG. 14, a solid cylindrical fourth punch P4 is lowered toward the die D to smash and clench the shank 21 in the plug portion 23 of the modified male snap body 6 to form an swelled end 31, thereby fixedly joining the snap body 6 and the shank 21. As a result, the cloth C is clamped with increased reliability between the modified male face plate 4 and the modified male snap body 6 by synergy of the connection between the resilient plate 8 and the shank 21 and that between the shank 21 and the snap body 6.

Figure 15:
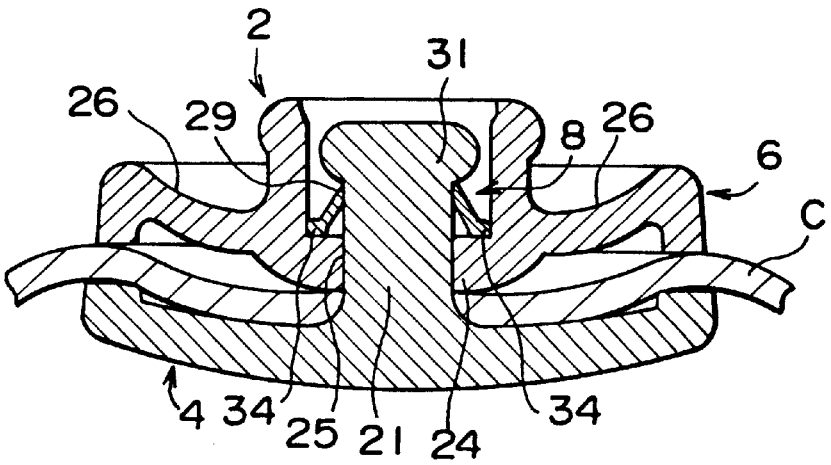
FIG. 15 is a cross-sectional view showing another modified male button according to a third embodiment of the invention.

Finally, FIG. 15 shows still another modified snap button (only still another modified male button 2 is shown) according to a third embodiment of the invention. The modified male button 2, like the male button 2 of the first embodiment, is basically composed of a face plate 4, a snap body 6 and a resilient plate 8. Each of the face plate 4 and the snap body 6 is identical in structure with those of the first embodiment, while only the resilient plate 8 is particularly different in structure from that of the first embodiment. Namely, in the modified male button 2, unlike the male button 2 of the first embodiment, the modified resilient plate 8 is in a form of a small-sized frustum resilient plate mounted in the plug portion 23 and has a central hole 29 and a radially outwardly bent outer peripheral edge 34. The foregoing structural features of the modified male button 2 are identical with those of the modified female button 1.

Now, a fourth method of attaching the modified male and female buttons 1, 2 of the third embodiment to the cloth C will now be described using FIGS. 16 and 17.

Figure 16:
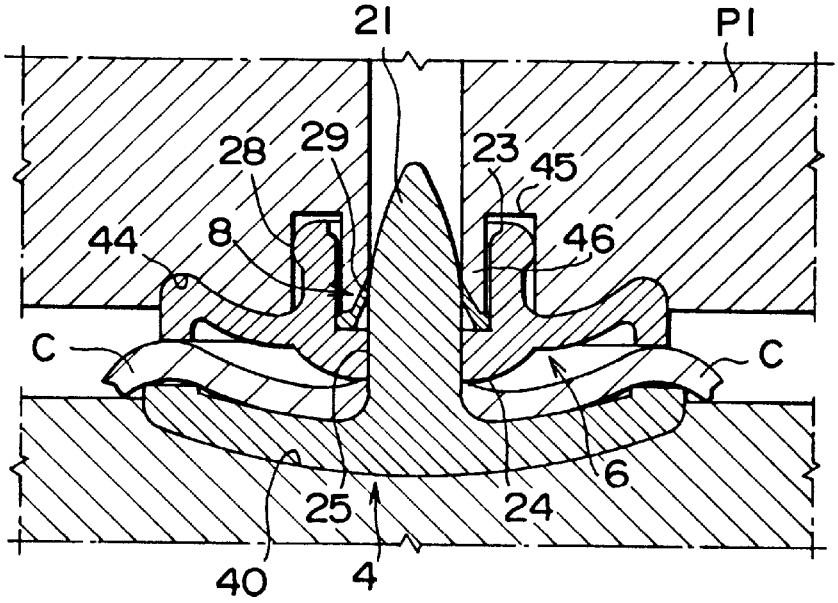
FIG. 16 is a cross-sectional view showing the operation of still another alternative assembling tool for the male button of the third embodiment in a first step of a fourth snap-button attaching method according to the invention.
Figure 17:
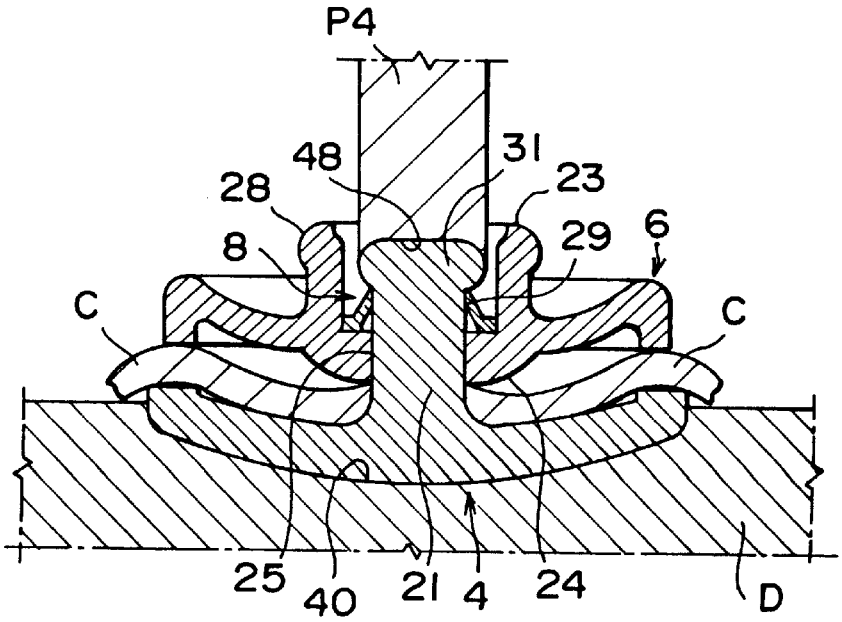
FIG. 17 is a cross-sectional view showing the operation of the assembling tool in a second step of the fourth method.
Figure 18:
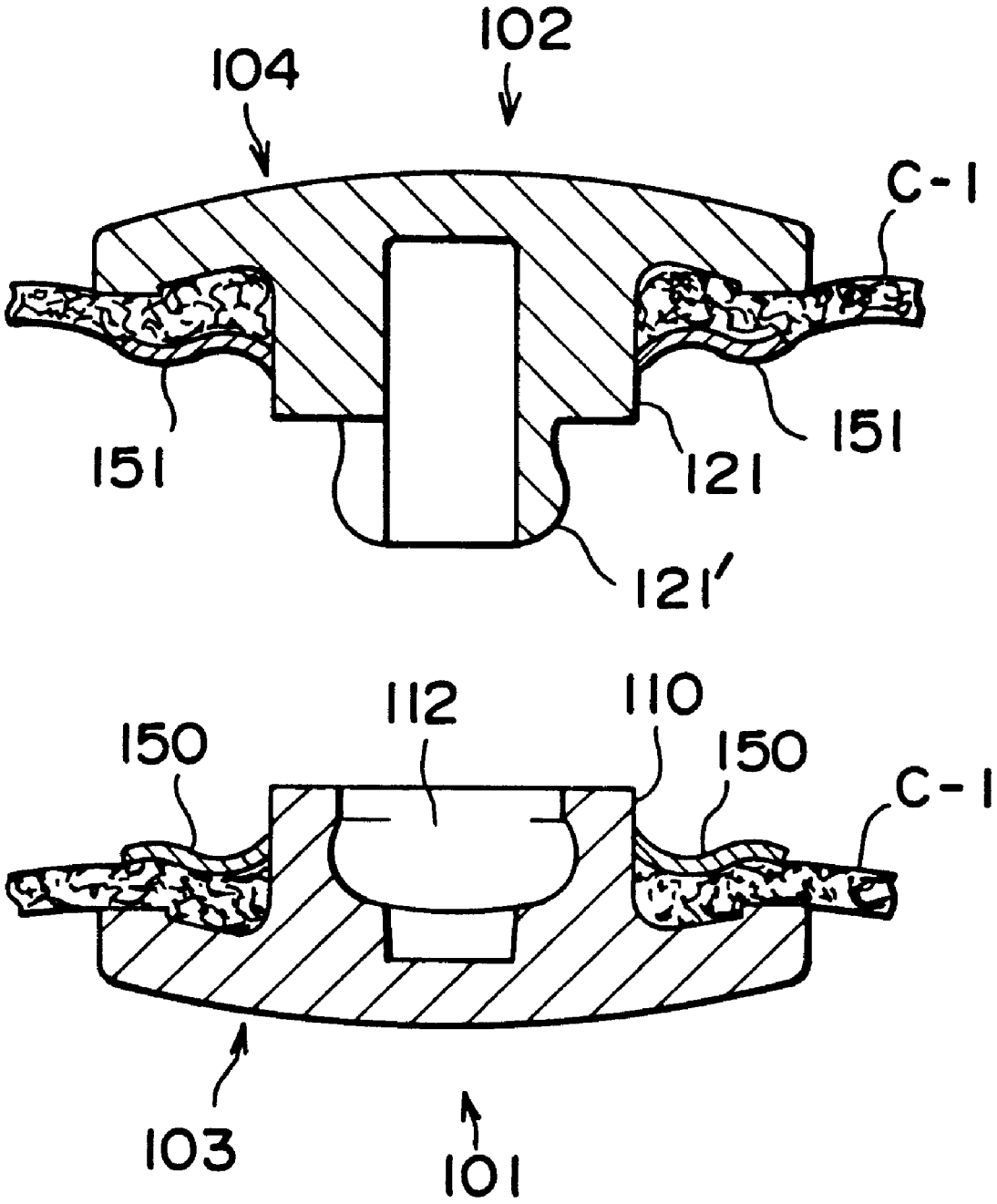
FIG. 18 PRIOR ART
FIG. 18 is a cross-sectional view of a conventional snap button.
Figure 19:
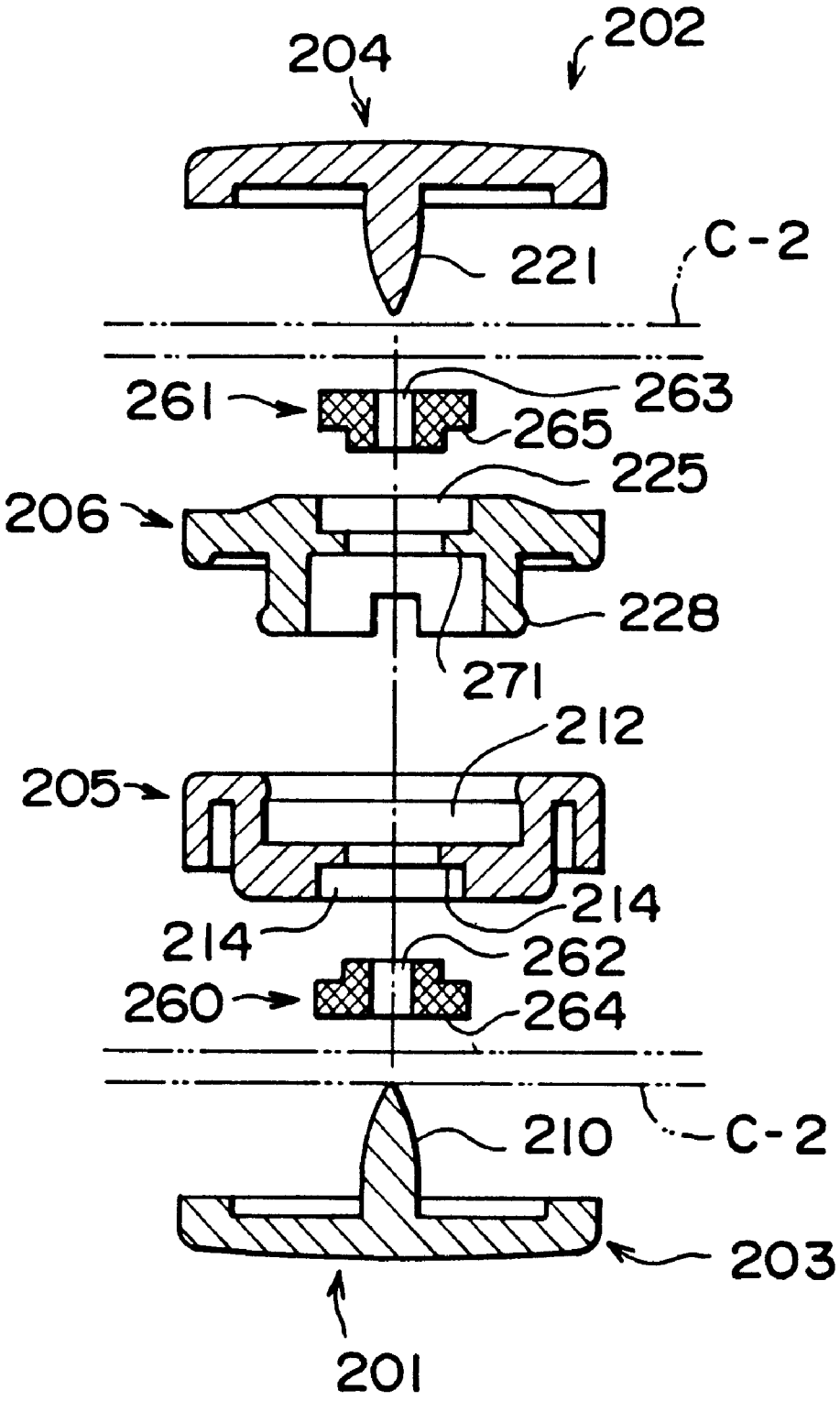
FIG. 19 PRIOR ART
FIG. 19 is an exploded cross-sectional view of another conventional snap button.
Figure 20:
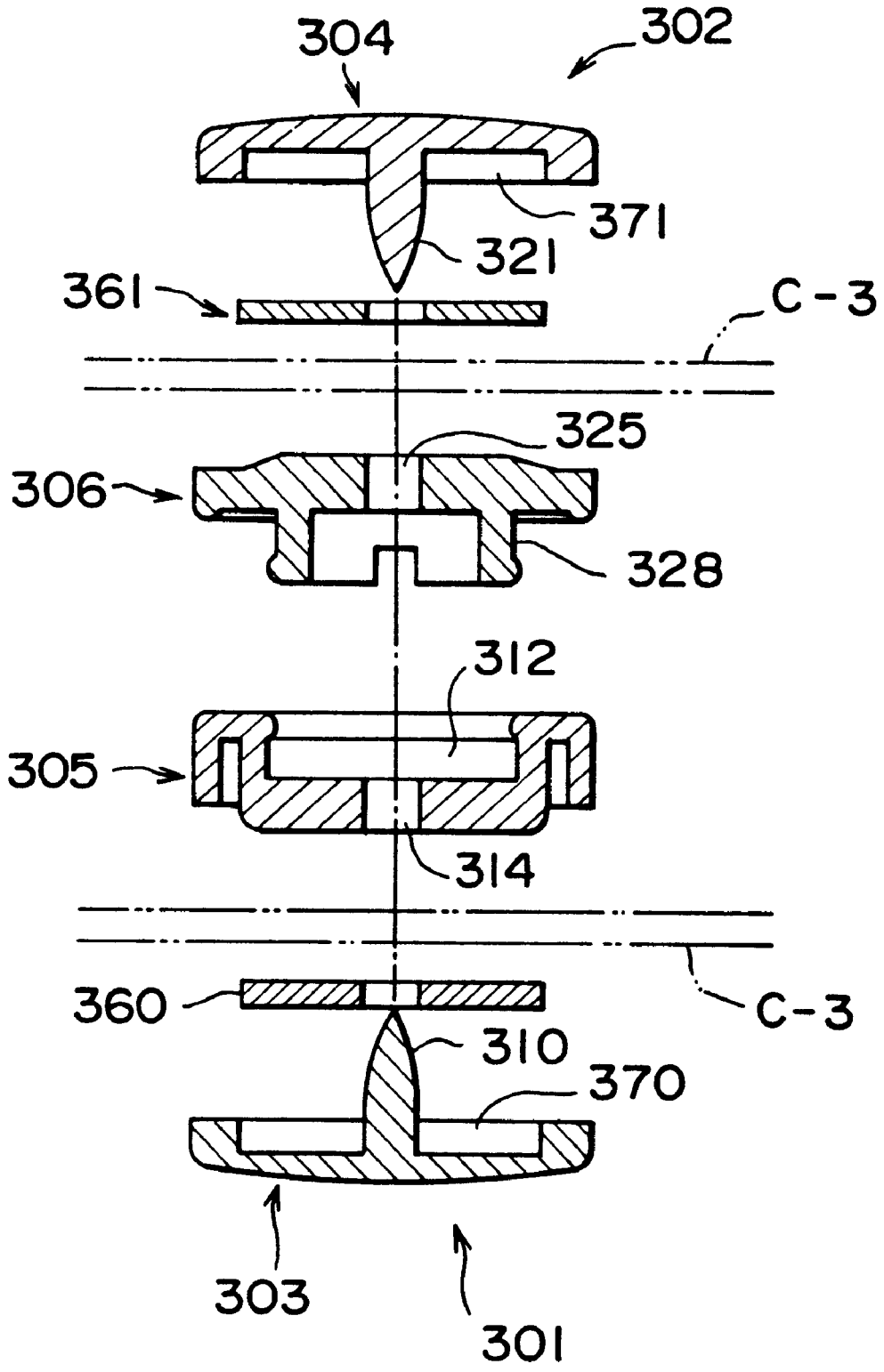
FIG. 20 PRIOR ART
FIG. 20 is an exploded cross-sectional view of still another conventional snap button.

In the first step of this fourth method, as shown in FIG. 16, with the face plate 4 of the modified male button 2 is supported in a seat recess 40 of a die D, the modified male resilient plate 8 is pressed by another alternative tubular first punch P1 to pierce its shank 21 through the cloth C and, at the same time, to thread the shank 21 through the bottom 24 of the plug portion 23 and the small-sized frustoconical resilient plate 8, thereby clamping the cloth C between the face plate 4 and the bottom 14 of the plug portion 24. An pressing surface of the further alternative tubular first punch P1 is defined partly by an annular cutout 45 at its inner side for receiving the plug portion 23 of the snap body 6, partly by an annular groove 44 contiguous to and outward of the annular cutout 45 for receiving the peripheral flange 26 of the snap body 6, and partly by an annular projection 46 having an end tapered at the inner side thereof for pressing the frustum resilient plate 8. As this further alternative first punch P1 is lowered toward the die D, the inside wall of the annular groove 45 comes against the annular protuberance 28 of the plug portion 23 to thereby hold the male snap body 6.

Upon completion of biting engagement of the inner peripheral edge 33 of the central hole 29 of the small-sized frustoconical resilient plate 8 with the shank 21, the further alternative first punch P1 is retracted away from the die D. At that time, the cloth C is clamped between an outward surface of the face plate 4 and the bottom 24 of the snap body 6. After that, in the second step of the fourth method, as shown in FIG. 17, a solid cylindrical fourth punch P4 is lowered toward the die D to smash and clench the shank 21 in the plug portion 23 of the modified male snap body 6 to form an swelled end 31. As a result, the swelled end 31 of the shank 21 embraces the inner peripheral edge of the central hole 29 of the small-sized frustoconical resilient plate 8 to thereby secure the frustoconical resilient plate 5 firmly. The pressing surface of the solid cylindrical fourth punch P4 is curved as an arcuate surface (as viewed in cross section) 48 to mold an arcuate shape (as viewed in cross section) of the swelled end 31.

With the snap buttons of the foregoing embodiments and the attaching methods according to the present invention, following advantageous results can be obtained:

According to the first aspect of the invention, the male and female buttons 2, 1 of the snap button comprises: a male face plate 4 having a smashable shank 21 projecting centrally from its inner surface for piecing a first part of the cloth C; a male snap body 6 having a concave plug portion 23, a first shank-insertion hole 25 extending axially through the plug portion 23, and a peripheral flange 26 extending from a base portion of the plug portion 23 off an inner open end thereof; a male resilient plate 8 adapted to be pierced by the shank 21 so as to press the first part of the cloth C against the inner surface of the male face plate 4; a female face 3 plate having a smashable shank 10 projecting centrally from its inner surface for piecing a second part of the cloth C; a female snap body 5 having a concave socket portion 12, a shank-insertion hole 14 extending centrally through the socket portion 12, and a peripheral flange 15 extending from a base portion of the socket portion 12 off an inner open end thereof; and a female resilient plate 3 adapted to be pierced by the last-mentioned shank 10 so as to press a second part of the cloth C against the inner surface of the female face plate 3. With this arrangement, since securing of the cloth C takes place at two positions, i.e., between the resilient plate 8, 7 and the shank 21, 10 and between the snap body 6, 5 and the shank 21, 10, it is possible to attach the snap button to the cloth C firmly and simply without any accidental removal of the face plate 4, 3 from the cloth C even when the snap body 6, 5 happens to suffer any breakage or other damage due to fatigue for repeated coupling and uncoupling operation of the button. Thus, a tough, stabilized double-sandwich-type snap button can be realized.

According to the second aspect of the invention, since each of the male and female resilient plates 8, 7 has an arcuate surface complementary to the inner surface of a respective one of the male and female face plates 4, 3 so that the cloth C can be clamped between the resilient plate 8, 7 and the face plate 4, 3, the face plate and the resilient plate can catch the cloth reliably and easily, thus firm and stable attachment of the snap button can be achieved.

According to the third aspect of the invention, partly since each of the male and female resilient plates 8, 7 has an inwardly curled peripheral edge 30, 20, and partly since each of the male and female snap bodies 6, 5 has an outwardly bent peripheral edge 27, 16, and yet partly since each of the plug and socket portions 23, 12 has an outwardly bulging bottom 24, 13 for pressing a respective one of the male and female resilient plates 8, 7 around its central hole 29 19, the resilient plate can press the cloth against the face plate 4, 3 by its entire surface to secure the cloth C firmly and stably, realizing a damage-proof tough snap button.

According to the fourth aspect of the invention, since the outer peripheral edge of each resilient plate 8, 7 is embedded in the outer peripheral edge of a respective one of the peripheral flanges 26, 15 of the male and female snap bodies 6, 5, it is possible to secure the resilient plate 8, 7 to the snap body 6, 5 reliably and firmly so that the resilient plate 8, 7 can be engaged with the shank 21, 10 in a stabilized posture with increased reinforcement.

According to the fifth aspect of the invention, partly since each of the male and female resilient plates 8, 7 has a central hole smaller in diameter than the respective shank 21, 10 and partly since a peripheral edge of the central hole 21, 10 is in biting engagement with the respective shank, it is possible to Join the shank 21, 10 of the face plate 4, 3 and the resilient plate 8, 7 together firmly without being accidental removed off each other.

According to the sixth aspect of the invention, since each resilient plate 8, 7 is initially devoid of any central hole and is adapted to be pierced by a respective one of the shanks 21, 10 under pressure, it is possible to join the shank of the face plate 4, 3 and the resilient plate 8, 7 together simply and firmly without being accidental removed off each other.

According to the seventh aspect of the invention, partly since an outer surface of each of the peripheral flanges 26, 15 of the male and female snap bodies 6, 5 is located outward of the bottom 24, 13 of a respective one of the plug and socket portions 23, 12, and partly since each resilient plate 8, 7 is superposed on an outer surface of a respective one of peripheral flanges 26, 15, and yet partly since each of the male and female snap bodies 6, 5 has around a respective one of the shank-insertion holes 25, 14 a peripheral recess 32 for allowing each resilient plate 8, 7 to deform, it is possible to locate the resilient plate in a stabilized posture against the snap body and to facilitate resilient deformation of the resilient plate and also to clamp and secure the cloth margin without difficulty.

According to the eighth aspect of the invention, since the peripheral edge of the central hole 29, 19 of each resilient plate 8, 7 is inwardly bent so as to bite into a respective one of the shanks 23, 12, it is possible to thread the shank 21, 10 of the face plate 4, 3 through the snap body 6, 5 reliably and simply and to engage the shank 21, 10 with the resilient plate 8, 7 firmly without accidental removal.

According to the ninth aspect of the invention, partly since the bottom 24, 13 of each of the plug and socket portions 23, 12 is located outward of a respective one of the peripheral flanges 26, 15 of the male and female snap bodies 6, 5 so as to clamp the cloth C between the bottom 24, 13 and each face plate 4, 3, and partly since each resilient plate 8, 7 is a small-sized frustum resilient plate 8, 7 mounted in a respective one of the concave plug and socket portions 23, 12, and yet partly since each shank 21, 10 is smashed so as to engage the frustum resilient plate 8, 7, it is possible to engage the resilient plate 8, 7 with the shank 21, 10 of the face plate 4, 3 simply and reliably and to achieve adequate engagement by the small-sized resilient plate so that material to be used can be saved, thus resulting in reduction of price.

According to the tenth aspect of the invention, partly since each face plate 4, 3 is made of a material softer than that of each resilient plate 8, 7 and partly since the shank 21, 10 of each face plate 4, 3 has an axial hollow portion therein, it is possible to smash or clench the shank 21, 10 when the face plate 4, 3 is attached to the snap body 6, 5 so that the snap button can be attached to the cloth quickly and reliably, thus improving the attaching efficiency.

According to the eleventh aspect of the invention, partly since each face plate 4, 3 and each snap body 6, 5 are molded of thermoplastic resin and partly since each resilient plate 7, 8 is made from a metal plate, it is possible to achieve reliable engagement using optimum materials for the snap body 6, 5, the face plate 4, 3 and the resilient plate 8, 7 so that reliable engagement can be achieved. As a result, an ideal snap button can be realized.

According to the twelfth aspect of the invention, since a method of attaching a snap button to a cloth comprises a first step of piercing the shank 21, 10 of the face plate 4, 3 of each of the male and female buttons 2, 1 through a respective one of first and second parts of the cloth C, inserting the shank 21, 10 through a central hole 29, 19, which is smaller in diameter than the shank 21, 10, of the resilient plate 8, 7 to clamp a respective one of the first and second part of the cloth C between the resilient plate 8, 7 and the face plate 4, 3, and a second step of pressing the shank 21, 10, which is inserted through the shank-insertion hole 6, 5 of the snap body 6, 5 of each of the male and female buttons 2, 1 to smash the shank 21, 10 in the snap body 6, 5, it is possible to secure each snap body 6, 5 of the snap button to the shank 21, 10 of each face plate 4, 3 firmly at two positions using the respective resilient plate 8, 7 and also to perform intermediate inspection between the first and second steps by the operator's eyes so that reliable checking can be performed, thereby guaranteeing a damage-free snap button.

According to the thirteenth aspect of the invention, since in the first step, the resilient plate 8, 7 is pressed first at its outer peripheral edge and then at a peripheral edge of the central hole 29, 19 to bring the resilient plate 8, 7 into engagement with the shank 21, 10 of the face plate 4, 3, the peripheral edge of the central hole 19 can be sufficiently deformed. Thus, since the peripheral edge can be bite into the shank 21, 10, it is possible to clamp the cloth simply and firmly.

According to the fourteenth aspect of the invention, in the first step, the resilient plate 8, 7 with the peripheral edge of the central hole 29, 19 resiliently deformable is superposed over the inner surface of each of the male and female snap bodies 6, 5, and each of the resilient plates 8, 7 is pressed against each snap body 6, 5, thereby engaging each shank 21, 10 of each face plate 4, 3. With this arrangement, since each snap body 6, 5 and the resilient plate 8, 7 are unitedly superposed, it is possible to perform both threading of the shank 21, 10 and pressing of the members once for all so that the pressing operation can take place reliably with maximum ease, thereby improving the rate of production.

According to the fifteenth aspect of the invention, partly since in the first step, each the snap body 6, 5 and a respect one of the first and second part of the cloth are threaded on each shank 21, 10 of the face plate 4, 3, and partly since a small-sized resilient plate 8, 7 is then threaded on each shank 21, 10 and is pressed against each snap body 6, 5, thereby engaging each shank 21, 10 of each face plate 4, 3, it is possible to perform both threading of the snap body 6, 5 and the small-sized resilient plate 8, 7 onto the shank 21, 10 of the face plate 4, 3 as a unitary structure and pressing of these members once for all, thus improving the rate of production.

What is claimed is:

1. A snap button, for attachment to a cloth, which is composed of male and female buttons adapted to be coupled together, said male and female buttons comprising:

(a) a male face plate having a smashable shank projecting centrally from its inner surface for piercing a first part of the cloth;

(b) a male snap body having a concave plug portion, a shank-insertion hole extending axially through said plug portion, and a peripheral flange extending from a base portion of said plug portion off an inner open end thereof, wherein the male snap body is biased toward the male face plate and presses the first part of the cloth against the male face plate when the shank of the male face plate is deformed;

(c) a male resilient plate adapted to be pierced by and engaged with said shank of the male face plate so as to press the first part of the cloth against the inner surface of said male face plate;

(d) a female face plate having a smashable shank projecting centrally from its inner surface for piercing a second part of the cloth;

(e) a female snap body having a concave socket portion, a shank-insertion hole extending centrally through said socket portion, and a peripheral flange extending from a base portion of said socket portion off an inner open end thereof, wherein the female snap body is biased toward the female face plate and presses the second part of the cloth against the female face plate when the shank of the female face plate is deformed; and (f) a female resilient plate adapted to be pierced by and engaged with the shank of the female face plate so as to press the second part of the cloth against the inner surface of said female face plate.

2. A snap button according to claim 1, wherein each of said male and female resilient plates has an arcuate surface complementary to the inner surface of a respective one of said male and female face plate.

3. A snap button according to claim 1 or 2, wherein each of said male and female resilient plates has an inwardly curled peripheral edge, each of said male and female snap bodies having an outwardly bent peripheral edge, each of said plug and socket portions having an outwardly bulging bottom for pressing a respective one of said male and female resilient plates around its central hole.

4. A snap button according to claim 3, wherein an outer surface of each of said peripheral flanges of said male and female snap bodies is located outward of said bottom of a respective one of said plug and socket portions, each said resilient plate being superposed on an outer surface of a respective one of said peripheral flanges, each of said male and female snap bodies having around a respective one of said shank-insertion holes a peripheral recess for allowing each said resilient plate to deform.

5. A snap button according to claim 3, wherein said peripheral edge of said central hole of each said resilient plate is inwardly bent so as to bite into a respective one of said shanks.

6. A snap button according to claim 2, wherein an outer peripheral edge of each said resilient plate is embedded in said outer peripheral edge of a respective one of said peripheral flanges of said male and female snap bodies.

7. A snap button according to claim 1, wherein each of said male and female resilient plates has a central hole smaller in diameter than a respective one of said shanks, a peripheral edge of said central hole being in biting engagement with each said shank.

8. A snap button according to claim 1, wherein each said resilient plate is initially devoid of a central hole and is adapted to be pierced by a respective one of said shanks under pressure.

9. A snap button according to claim 1, wherein said bottom of each of said plug and socket portions is located outward of a respective one of said peripheral flanges of said male and female snap bodies so as to clamp the cloth between said bottom and each said face plate, each said resilient plate being a small-sized frustum resilient plate mounted in a respective one of said concave plug and socket portions, each said shank being smashed so as to engage said frustum resilient plate.

10. A snap button according to claim 1 or 9, wherein each said face plate is made of a material softer than that of each said resilient plate, said shank of each said face plate having an axial hollow portion therein.

11. A snap button according to claim 10, wherein each said face plate and each said snap body are molded of thermoplastic resin, and each said resilient plate is made from a metal plate.

12. A method of attaching to a cloth a snap button composed of male and female snap buttons, each having a face plate, a shank projecting centrally therefrom, a resilient plate and a snap body having a shank-insertion hole, said method comprising:

(a) a first step of piercing each said shank of the face plate of each of the male and female buttons through a respective one of first and second parts of the cloth, inserting said each shank through a central hole, which is smaller in diameter than said each shank, of the resilient plate to clamp a respective one of the first and second parts of the cloth between the resilient plate and the face plate; and (b) a second step of pressing the shank, which is inserted through the shank-insertion hole of the snap body of each of the male and female button to smash the shank in the snap body and clamp the respective one of the first and second parts of the cloth against the face plate.

13. A method according to claim 12, wherein in said first step, the resilient plate is pressed first at its outer peripheral edge and then at a peripheral edge of the central hole to bring the resilient plate into engagement with the shank of the face plate.

14. A method according to claim 12, wherein in said first step, each said resilient plate with the peripheral edge of the central hole resiliently deformable is superposed over the inner surface of each of said male and female snap bodies, and pressed against each said snap body, thereby engaging with each said shank of each said face plate.

15. A method according to claim 12, wherein in said first step, each said snap body and a respect one of the first and second part of the cloth are threaded on each said shank of the face plate, and a small-sized resilient plate is then threaded on each said shank and is pressed against each said snap body, thereby engaging with each said shank of each face plate.

* * * * *